US006376986B1

(12) United States Patent
Takagi et al.

(10) Patent No.: US 6,376,986 B1
(45) Date of Patent: Apr. 23, 2002

(54) PLASMA DISPLAY PANEL

(75) Inventors: Kazushige Takagi; Tadayoshi Kosaka; Fumihiro Namiki, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/563,136

(22) Filed: May 2, 2000

(30) Foreign Application Priority Data

May 11, 1999 (JP) ..... 11-129483

(51) Int. Cl.[7] ..... H01J 11/00; H01J 17/16
(52) U.S. Cl. ..... 313/582; 313/584; 345/60
(58) Field of Search ..... 313/581, 582, 313/584, 585; 345/60; 315/169.4

(56) References Cited

U.S. PATENT DOCUMENTS 5,659,226 A 8/1997 Shigeta
5,825,128 A 10/1998 Betsui et al.
5,889,365 A * 3/1999 Tanabe ..... 345/60
6,097,357 A * 8/2000 Shinoda et al. ..... 313/585 X
6,333,599 B1 * 12/2001 Kawanami et al. ..... 313/582

FOREIGN PATENT DOCUMENTS

JP 9-50768 2/1997
WO 98/54743 12/1998

* cited by examiner

*Primary Examiner*—Ashok Patel
(74) *Attorney, Agent, or Firm*—Staas & Halsey LLP

(57) ABSTRACT

A plasma display panel is provided that can prevent interference of discharge between rows securely without reducing operation margin. Plural partitions being at a distance from each other define a discharge space of each column in the screen. The column space defined by the partitions is narrowed periodically along the column direction. A surface discharge gap is formed at each enlarging portion of the column space. A pair of plural main electrodes is provided for surface discharge. Each of the main electrodes includes a belt-like bus portion extending in the row direction of the screen and plural gap forming portions protruding in the column direction from the bus portion toward the enlarging portion in each column space.

14 Claims, 14 Drawing Sheets

PLASMA DISPLAY PANEL

BACKGROUND OF THE INVENTION

1. Field of the Invention

The present invention relates to a surface discharge type plasma display panel (PDP) in which main electrodes making a pair extend in parallel as row electrodes defining rows of a screen.

It is said that a ratio of a main electrode area and a cell area (an area ratio) is better to be smaller for improving a light emission efficiency (1m/W) that is a light emission quantity (luminous flux) per a unit power consumption in a plasma display panel. In "The latest in Technology of Plasma Display," (Mikoshiba, ED Research Co.) the following equation is disclosed.

light emission efficiency=1/(1+cxdischarge current density), where c is a constant.

Two of the reasons the light emission efficiency is improved are as follows. First, non-effective power consumed for charging a capacitance between the electrodes is reduced. Secondly, the discharge current decreases along with the decrease of the area ratio, and self-absorption of a vacuum ultraviolet light by discharge gas decreases so that excitation efficiency is enhanced.

However, if the width of the main electrode is reduced for decreasing the area ratio, the gap length of the surface discharge is increased. In this case, although the capacitance between the electrodes decreases, a discharge starting voltage increases and a voltage margin of driving decreases.

The increase of the cell number for a wide screen and a high definition causes an increase of power consumption. The reduction of the power consumption is important from a viewpoint of reducing generation of heat. It is required to satisfy both securing an operation margin for a stable display and improving the light emission efficiency.

2. Description of the Prior Art

FIG. 13 is a plan view showing the conventional electrode structure. FIG. 14 is a perspective view showing an inner structure of the conventional plasma display panel.

The illustrated plasma display panel 9 has a structure disclosed in Japanese unexamined patent publication No. 9-50768. Main electrodes Xq, Yq, a dielectric layer 17 and a protection film 18 are provided on the front side glass substrate 11. On the backside glass substrate 21, there are provided address electrodes A as row electrodes, an insulator layer 24, partitions 29 for defining a discharge space 30, and fluorescent layers 28R, 28G and 28B for color display. Each of the main electrodes Xq, Yq includes a transparent conductive film 41*q* and a metal film 42*q*. The main electrodes Xq, Yq are arranged alternately at a constant space (a surface discharge gap) in the column direction. The gap direction of the surface discharge gap, i.e., the direction in which the main electrodes Xq, Yq face each other is the column direction. The discharge space 30 is filled with a two-component gas such as neon and xenon.

In the plasma display panel 9, the partition 29 that divides the discharge space 30 in each column has a ribbon shape meandering regularly in a plan view. As shown in FIG. 14, each partition 29 is meandering at a constant pitch and width in a plan view, and is arranged so that the distance between the neighboring partitions 29 becomes smaller than a constant value periodically along the column direction. The constant value is a distance that can suppress the discharge and is determined by the discharge condition such as a gas pressure. Since the partitions 29 are disposed separately, the space (a column space) 31 between the neighboring partitions is continuous over the all rows of the screen. Thus, easiness of the drive in each column by priming, uniformity of the printing state of the fluorescent layer and easiness of the exhausting process in manufacturing can be realized. In the plasma display panel 9, a red fluorescent layer 28R, a green fluorescent layer 28G and a blue fluorescent layer 28B are arranged in this order for each column. The light emission color of each row in a column is the same.

A portion (a narrowing portion) 31B of the column space 31 in which the width in the row direction is small cannot generate the surface discharge easily, so a portion (enlarging portion) 31A having a wide width substantially contributes the light emission. Therefore, a cell that is a display element is disposed at every two columns in each row. Noting the neighboring two rows, the column in which a cell is disposed changes alternately one by one column. Namely, cells are arranged in a staggered pattern both in the row direction and the column direction. In the plasma display panel 9, the neighboring three cells of red, green and blue colors constitute a pixel. The arrangement format of the color display by the three colors is a triangle (delta) format. The triangle arrangement has an advantage for high definition compared with an inline arrangement since the width of the cell is larger than one third of the pixel pitch in the row direction. In addition, it can perform a high intensity display since a ratio of non-emission area of the screen is small.

In the conventional structure, the shape of the main electrodes Xq, Yq in a plan view is like linear ribbon having a constant width over the full length of the screen, and the main electrodes Xq, Yq are close to each other in the narrowing portion 31B as well as the enlarging portion 31A of the column space 31. Therefore, an error discharge can be generated in the narrowing portion 31B. If attempting to prevent the error discharge completely by setting the drive voltage, the operation margin will become small. It is also a problem that a waste of power consumption for charging a capacitance between the electrodes is large.

SUMMARY OF THE INVENTION

The object of the present invention is to prevent the interference of discharge between the rows securely without decreasing the operation margin. Another object of the present invention is to reduce a capacitance between electrodes. Still another object of the present invention is to reduce a discharge current so as to improve a light emission efficiency.

In the present invention, the shape of the main is selected so that an electrode area ratio at a narrowing portion in a column space is smaller than an electrode area ratio at an enlarging portion, and the maximum value of the electrode gap between rows at the narrowing portion is larger than the minimum value of the electrode gap at the enlarging portion (i.e., surface discharge gap length). If the electrode area ratio at the narrowing portion is small, the diffusion of the discharge along the electrode is suppressed so that the interference of the discharge in the column direction is prevented. It is the best that the main electrode is provided so that the electrode area ratio becomes zero, i.e., so as to avoid the narrowing portion. In addition, by enlarging the electrode gap between rows at the narrowing portion for a part or the entire of the opposing area of the electrodes, a capacitance between the electrodes is reduced. Thus, a waste of power consumption is reduced so that the light emission efficiency is improved.

In the present invention, the main electrode is formed in the shape having a belt-like portion extending in the row direction and a half circle portion protruding toward the enlarging portion of each column. The half circle portion opposes the other half circle portion of the neighboring main electrode so as to form a surface discharge gap, The electrode area in the cell decreases by the extent of the gap between the half circle portion and the belt-like portion. As a result, the discharge current decreases so that light emission efficiency is improved. It is not necessary to increase the surface discharge gap length for decreasing the electrode area. Namely, a predetermined operation margin can be secured. By increasing the number of lighting times per a period, the drop of the intensity due to the decrease of the discharge current can be compensated. It is preferable for the intensity to form the half circle portion with a transparent conductive film such as ITO or Nesa when arranging the main electrode at the front side of the discharge space. If the main electrode is arranged at the rear side of the discharge space, consideration for light shield by the electrode is not necessary, so the belt-like portion and the half circle portion can be formed with a metal film. In this case too, the belt-like portion reduces the line resistance of the electrode. When omitting the belt-like portion, the electrode shape becomes a meandering belt-like and the entire length becomes larger than the screen, so the voltage drop becomes outstanding.

According to a first aspect of the present invention, a plasma display panel includes a plurality of partitions being apart from each other and defining a discharge space of each column in a screen, and a column space defined by the partitions. The column space is narrowed periodically along the column direction. A surface discharge gap is formed at each enlarging portion of the column space. A pair of main electrodes for surface discharge is provided, and each of the main electrodes includes a belt-like bus portion extending in the row direction of the screen and plural gap forming portions protruding from the bus portion in the column direction at each intersection with the partition.

According to a second aspect of the present invention, the arrangement distance of the plural gap forming portions in the row direction is substantially equal to the partition distance of the narrowing portion of the column space or is larger than the same.

According to a third aspect of the present invention, the bus portion is made of a metal film, and each of the plural gap forming portions is made of a transparent conductive film that is patterned so as to protrude from the bus portion to both sides in the column direction.

According to a fourth aspect of the present invention, each of the main electrodes that make an electrode pair for surface discharge includes a belt-like bus portion extending in the row direction of the screen and plural gap forming portions protruding from the bus portion toward the enlarging portion in the column direction in each column space.

According to a fifth aspect of the present invention, the arrangement distance of the plural gap forming portions in the row direction is substantially equal to the partition distance of the narrowing portion of the column space or is larger than the same.

According to a sixth aspect of the present invention, the bus portion is made of a metal film, and each of the plural gap forming portions is made of a transparent conductive film that is patterned in the belt-like shape extending in the row direction while meandering in the column direction.

According to a seventh aspect of the present invention, each of the plural gap forming portions includes a first linear pattern extending in the row direction at a distance from the bus portion and two second linear patterns that connect each end of the first linear pattern to the bus portion.

According to an eighth aspect of the present invention, both ends of the first linear pattern protrude from the second linear pattern connecting the first linear pattern in the row direction.

According to a ninth aspect of the present invention, each of the plural gap forming portions is patterned in such a shape that opposing sides of the plural gap forming portions and the other main electrode forming the surface discharge gap together are not parallel to each other.

According to a tenth aspect of the present invention, each of the plural gap forming portions has an arc shape whose ends are connected to the bus portion.

According to an eleventh aspect of the present invention, a plasma display panel includes a plurality of partitions being apart from each other and defining a discharge space of each column in a screen and a column space defined by the partitions. The column space is narrowed periodically along the column direction and a surface discharge gap is formed at each enlarging portion of the column space. A pair of main electrodes for surface discharge is arranged at the front side of the discharge space. Each of the main electrodes includes a belt-like bus portion extending in the row direction while meandering in the column direction along the partition in a plan view, and plural gap forming portions protrudes from the bus portion toward the enlarging portion in the column direction in each column space. The bus portion is made of a metal film. Each of the plural gap forming portions has a belt-like shape connected to the bus portion only at both ends, and being made of a transparent conductive film extending in the row direction while meandering in the column direction.

According to a twelfth aspect of the present invention, each of the main electrodes includes a belt-like bus portion extending in the row direction while meandering in the column direction along the partition in a plan view and plural linear belt-like gap forming portions protruding in the row direction at each enlarging portion of the column space. Each of the main electrodes is patterned in the shape having a gap between each of the plural gap forming portions and the bus portion. The bus portion is made of a metal film. The plural gap forming portions are made of a transparent conductive film.

According to a thirteenth aspect of the present invention, each of the plural main electrodes is made of the metal film and at least two linear belt-like transparent conductive films extending in the row direction over the full length of the screen while being at a distance from each other.

According to a fourteenth aspect of the present invention, the transparent conductive film is patterned in the shape having a connection pattern for connecting the center of each gap forming portion in the row direction to the bus portion.

DESCRIPTION OF THE PREFERRED EMBODIMENTS

Figure 1:
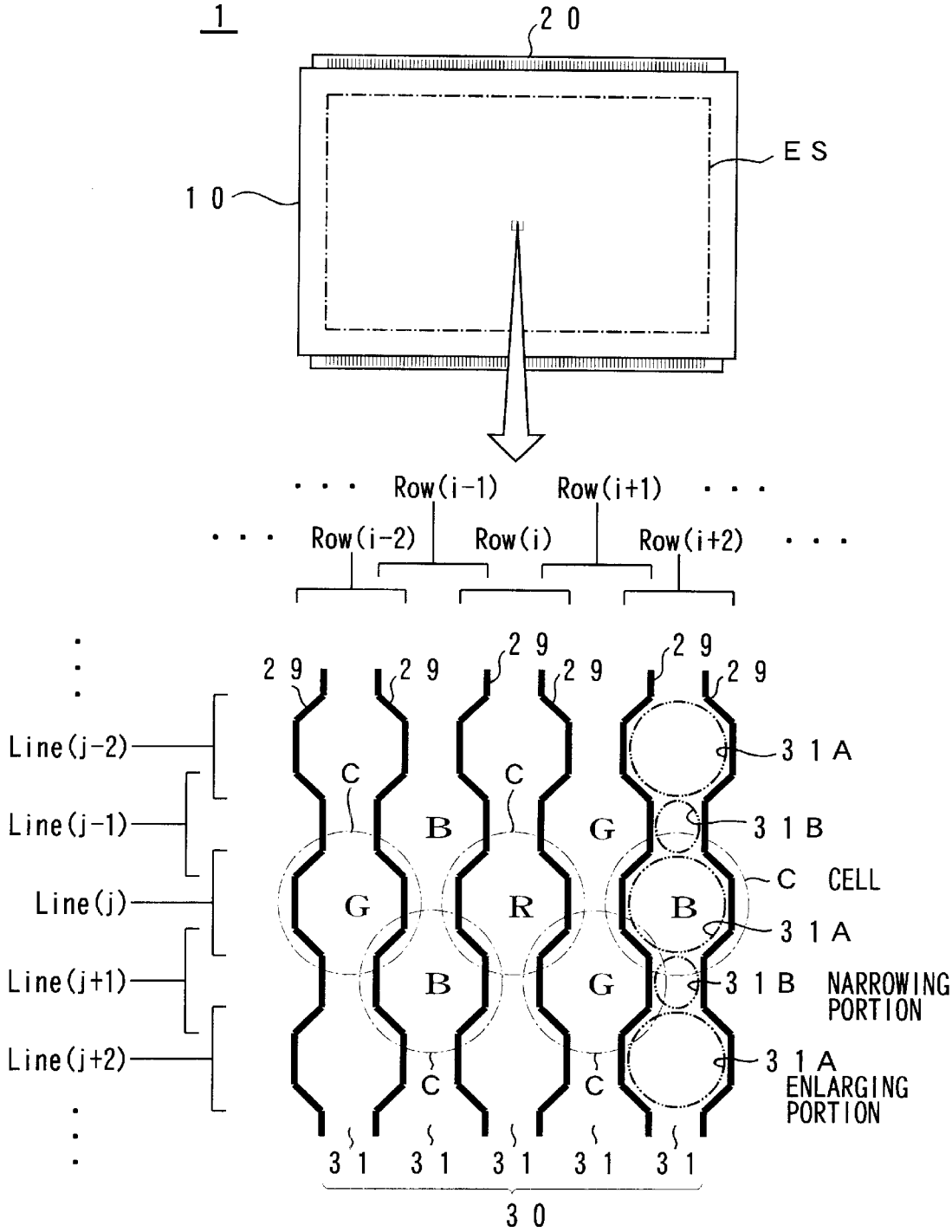
FIG. 1 shows a screen structure of a plasma display panel according to the present invention.
Figure 2:
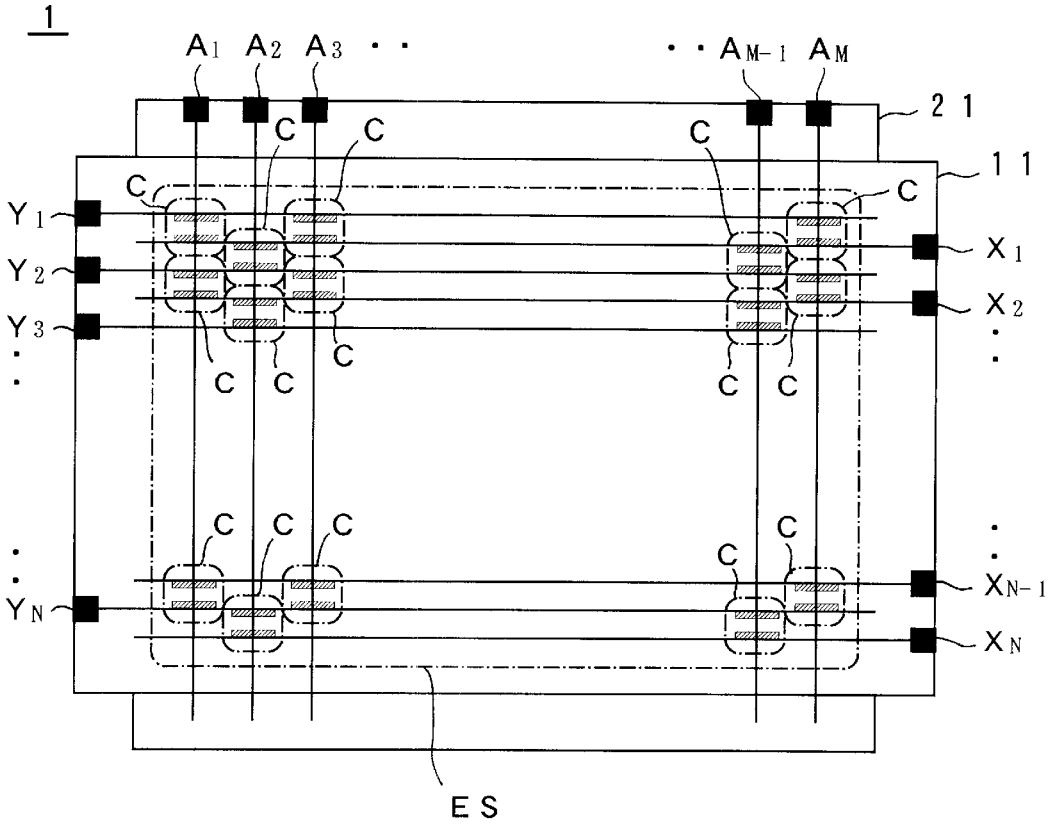
FIG. 2 is a schematic diagram of an electrode matrix.

FIG. 1 shows a screen structure of a plasma display panel according to the present invention. FIG. 2 is a schematic diagram of an electrode matrix.

Figure 13:
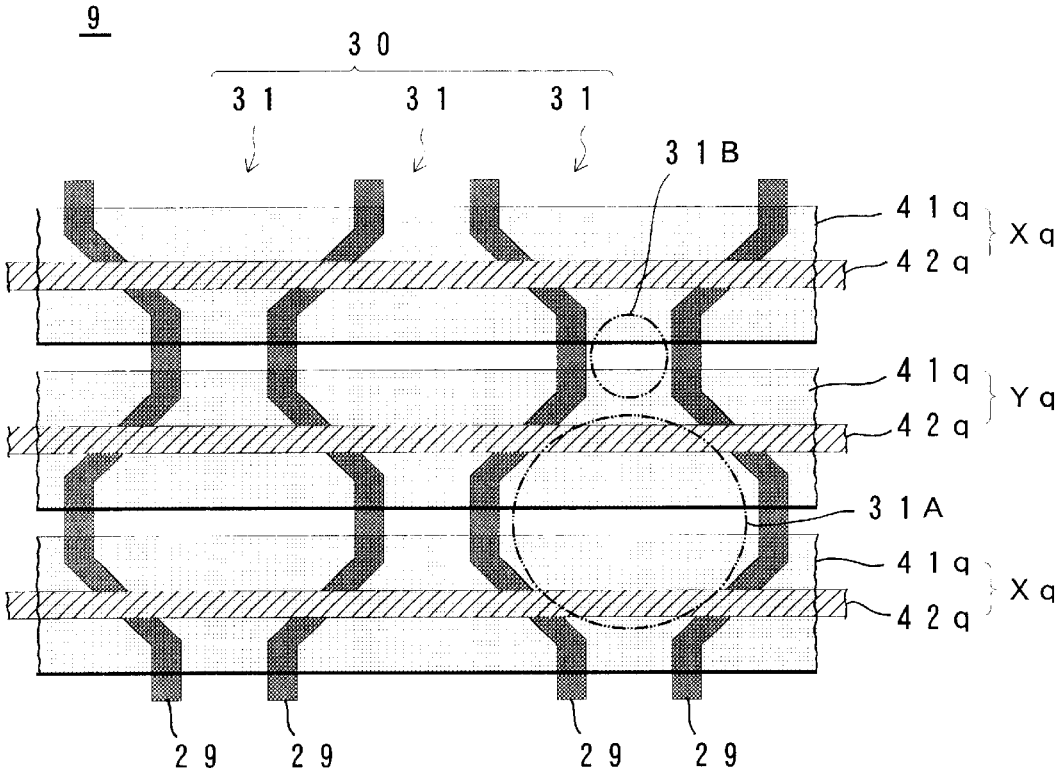
FIG. 13 is a plan view showing the conventional electrode structure.
Figure 14:
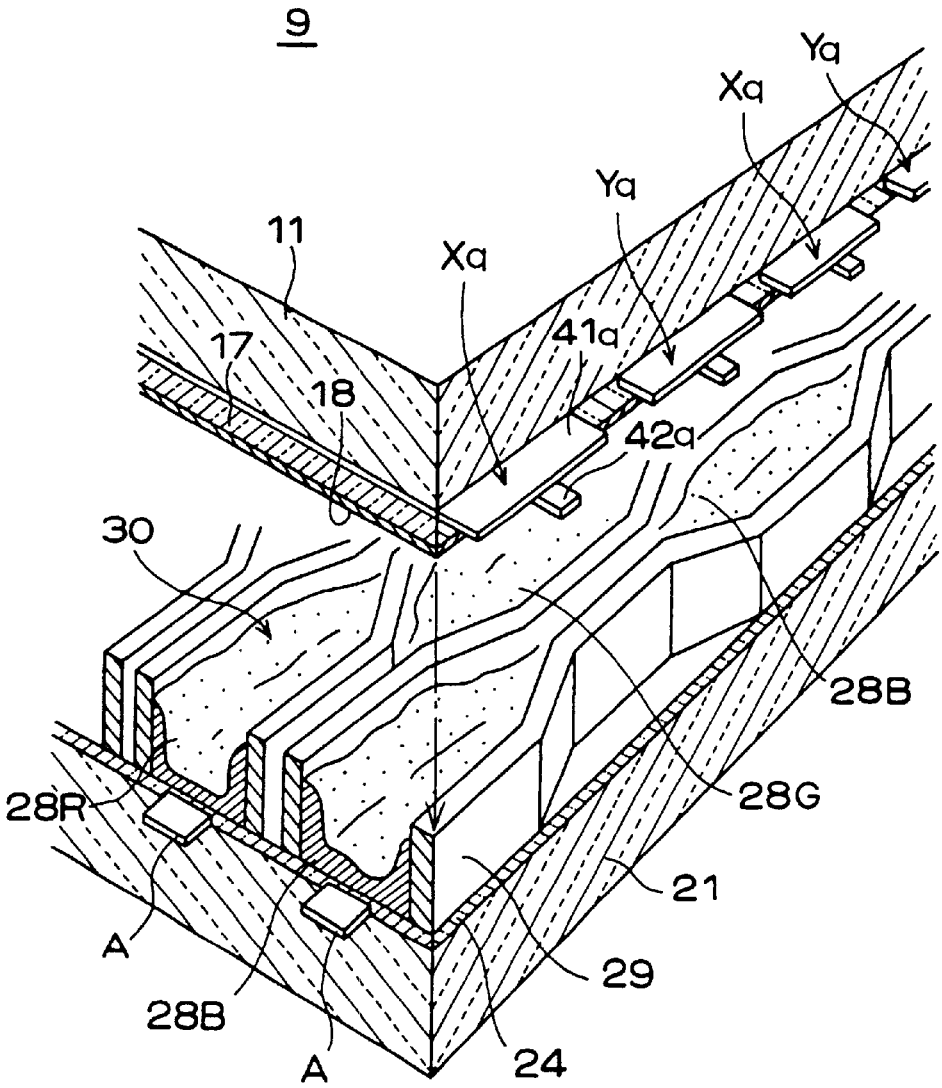
FIG. 14 is a perspective view showing an inner structure of the conventional plasma display panel.

The illustrated plasma display panel 1 is an AC type color plasma display panel having a surface discharge structure, which has a pair of substratal structures 10, 20. The substratal structure is a structural member having a glass substrate on which electrodes and other elements are disposed. The structure of the plasma display panel 1 is the same as that of the conventional plasma display panel 9 shown in FIG. 13 except the structure of the main electrode. Therefore, the explanation of some parts of the construction elements is omitted.

The screen ES is made up of many cells C arranged in a staggered pattern. The arrangement of red, green and blue is a triangle arrangement format. Within the screen ES in a plan view, the discharge space 30 is defined by partitions 29 that meander regularly, so that a column space 31 is formed in which enlarging portions 31A and narrowing portions 31B are arranged alternately. Each cell C is a structural member within one enlarging portion 31A in the screen ES. In FIG. 1, five cells C are illustrated as representatives by a circle of a chain line. (The circle encloses a little larger area than the real product for easy understanding.)

A row (line) in the display control, i.e., a set of cells in the line-sequential addressing for generating a charge distribution corresponding to display data includes cells C arranged in the horizontal direction at every two columns in the same vertical direction. The position of the cell in the odd row is shifted from that in the even row by one column in the horizontal direction. The horizontal direction is not always the row direction. The vertical direction can be the row direction, and the horizontal direction can be the column direction.

As shown in FIG. 2, in each cell C of the screen ES, a pair of main electrodes X, Y that are patterned in the shape unique to the present invention cross the address electrode A that is a third electrode. The main electrodes X, Y are arranged on the inner surface of the glass substrate 11 of the front side substratal structure 10 and are extending over the full length of the screen ES in the row direction. The main electrodes X, Y is led to the outside of the screen ES in the right and left directions so as to be connected to a printed wiring board (not shown) at the vicinity of the edge of the glass substrate 1. The connecting portion is enlarged as a terminal. Each of the main electrodes X, Y has a multilayer structure including a transparent conductive film and a metal film (so-called a bus electrode) that will be mentioned later. The leading out portion of the outside of the screen ES includes only the metal film. The metal film 42 has a three-layer structure such as chrome-copper-chrome.

In the example of FIG. 2, a total N of main electrodes $Y_1$–$Y_N$ and a total N of main electrodes $X_1$–$X_N$ are arranged alternately, so the number of rows in the screen ES is 2N. The main electrode $Y_1$ of the front end in the arrangement and the main electrode $X_n$ of the rear end are related to display of only one row. However, the other main electrodes $Y_2$–$Y_N$, $X_1$–$X_{N-1}$ are related to the display of two neighboring rows.

A total M of address electrodes $A_1$–$A_M$ are arranged on the inner surface of the glass substrate 21 of the backside substratal structure 20. Each of the address electrodes $A_1$–$A_M$ is related to the display of one column.

The general explanation of the drive control of the plasma display panel 1 is as follows.

A scan pulse is applied to the main electrodes $Y_1$–$Y_N$ one by one in a predetermined order. In synchronization with this, an address pulse is applied to the address electrodes $A_1$–$A_M$ in accordance with the display data for addressing. Namely, an appropriate quantity of wall charge is formed only at a portion within the cell to be lightened in the dielectric layer 17 spreading throughout the screen. After that, the pulse is applied alternately to the main electrodes X, Y, so that all cells C are supplied with the sustaining voltage Vs having alternating polarity. The sustaining voltage Vs satisfies the following equation.

$$Vf-Vw<Vs<Vf,$$

where Vf is a discharge starting voltage and Vw is a wall charge.

In a cell having an appropriate quantity of wall charge, the wall voltage Vw is added to the sustaining voltage Vs. Therefore, the effective voltage Vc added to the cell C exceeds the discharge starting voltage Vf, so that a surface discharge can be generated between the main electrodes along the substrate surface (a protection film 18). The xenon in the discharge gas emits ultraviolet rays that excite the fluorescent material to emit light in the cell in which the surface discharge occurs.

Therefore, for the color display, the original image (a frame or a field that is a part of the frame) is divided to plural subfields having weights of intensity, so that the ON or OFF of each cell C is controlled by the subfield unit. If the number of subfield is eight, 256-step of gradation display can be performed for each color (red, green and blue), so the number of display color is $256^3$. Basically, the addressing and sustaining are performed for each subfield. The length of the sustaining period that is the number of discharge times is substantially proportional to the weight of the intensity.

Hereinafter, plural examples will be explained for the shape of the main electrode to which the present invention is applied. In order to avoid complicated diagrams and explanations, common reference numerals are used in all examples as a general rule. However, for easy understanding of the difference of the structure, low case characters (b, c, d, . . . j) are suffixed to the reference numerals in each example after a second example.

Figure 3:
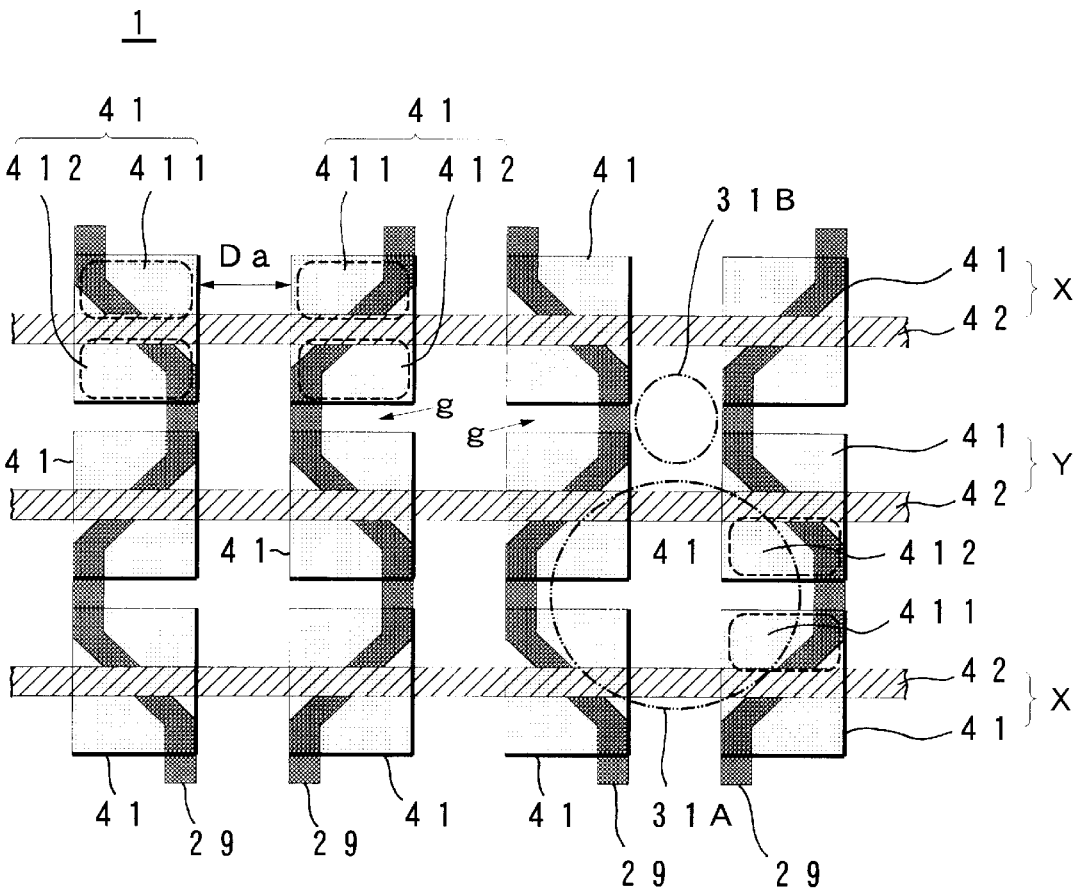
FIG. 3 shows a first example of the shape of the main electrode.

FIG. 3 shows a first example of the shape of the main electrode. Since the main electrodes X, Y are symmetric with each other, the reference numerals in the figure are used for the main electrode X as a representative. It is the same in the other figures.

In the first example, each of the main electrodes X, Y includes plural stripe-like transparent conductive films 41 arranged substantially at a uniform space in the row direction, a linear belt-like metal film 42 extending in the row direction. Each transparent conductive film 41 is arranged at each intersection of the main electrodes X, Y and the partition 29, and the arrangement distance Da is equal to a partition distance in the narrowing portion 31B of the column space. (Actually, there is an error due to production process.) The metal film 42 is positioned so as to overlap the center portion of each transparent conductive film 41 in the column direction. Therefore, in the plan view shape, each of the main electrodes X, Y includes a linear belt-like bus portion and plural gap forming portions 411, 412 protruding from the bus portion at each intersection position with the partition. The metal film 42 corresponds to the bus portion, and the portion of the transparent conductive film 41 that is not overlapped with the metal film 42 corresponds to the gap forming portions 411, 412.

The metal film (bus portion) 42 is arranged to pass the edge of the enlarging portion 31A in the column direction in the column space so that the minimum light shield is obtained. In each enlarging portion 31A, the transparent conductive film 41 of the main electrode X and the transparent conductive film 41 of the main electrode Y neighboring the main electrode X so as to form two surface discharge gap g divided into a left portion and a right portion.

As mentioned above, since the transparent conductive film 41 is disposed with the arrangement distance Da, there is no main electrode in the narrowing portion 31B. Therefore, compared with the conventional structure, the intensity of electric field in the narrowing portion 31B becomes small, and the charge moving from the enlarging portion 31A to the other enlarging portion 31A is reduced. Namely, since the interference of discharge between the rows is suppressed, the flexibility of designing the length of the surface discharge gap is enhanced, and sufficient operation margin can be secured. Since the average value of the main electrode gap becomes larger than the surface discharge gap length, the capacitance between the electrodes is reduced. In addition, the reduction of the electrode area makes the light emission efficiency increase. Furthermore, as a side effect the discharge is concentrated in the vicinity of the partition 29, so the fluorescence of the fluorescent material covering the side surface of the partition 29 is enhanced and the light emission efficiency is further improved.

Figure 4:
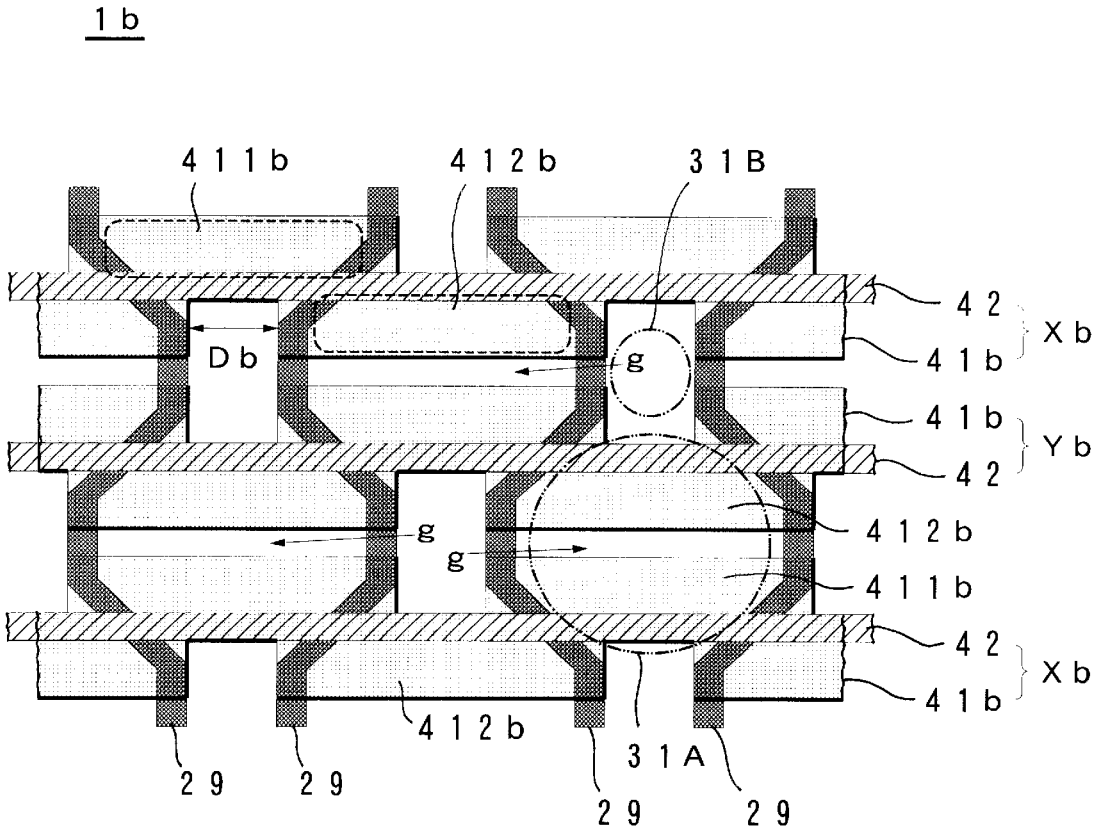
FIG. 4 shows a second example of the shape of the main electrode.

FIG. 4 shows a second example showing the shape of the main electrode.

Each of the main electrode Xb, Yb includes a belt-like transparent conductive film 41*b* meandering and extending in the column direction and the metal film 42 that is similar to the one explained in the above-mentioned example. The transparent conductive film 41*b* is patterned in the shape that includes a linear belt-like bus portion extending in the row direction and plural gap forming portions 411*b*, 412*b* protruding from the bus portion toward the enlarging portion 31A in each side of in the column direction in each column space. The bus portion corresponds to the portion overlapping the metal film 42. In one side (the odd row side or the even row side) of the metal film 42, the arrangement distance Db of the gap forming portions 411*b*, 412*b* is substantially equal to the partition distance of the narrowing portion 31B. Namely, the electrode in this second example has the shape in which the transparent conductive films 41 neighboring in the row direction in the first example shown in FIG. 3 are connected within the enlarging portion 31A. The area of the connected portion is selected properly so that the reduction of the intensity due to the reduction of the electrode area is suppressed to the minimum. Thus, the operation margin is enlarged as a valance adjustment. Adopting the structure of the second example, both the discharge current and the reactive current for charging the capacitance were reduced by approximately 30%, and the light emission efficiency was improved by approximately 40%.

Figure 5A:
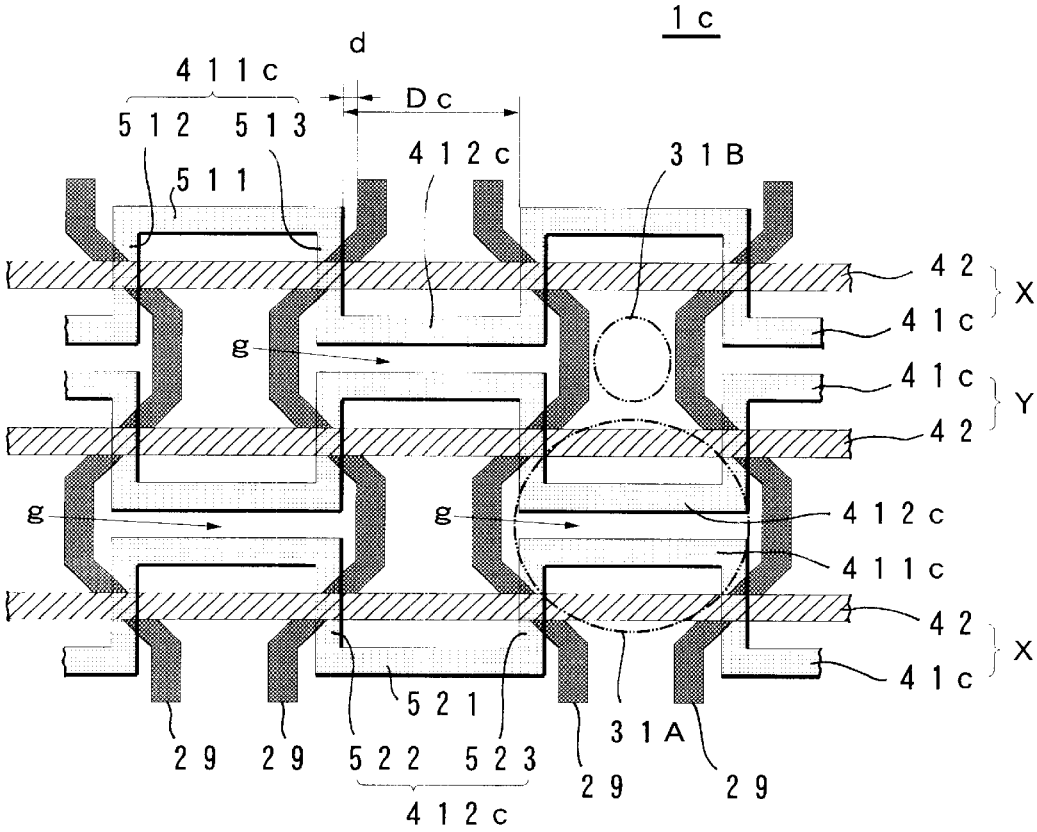
FIGS. 5A–5C show a third example of the shape of the main electrode.
Figure 5B:
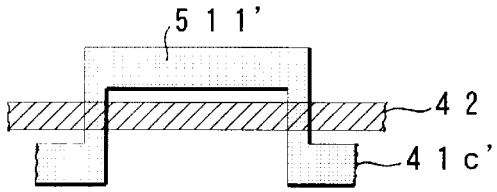
Figure 5C:
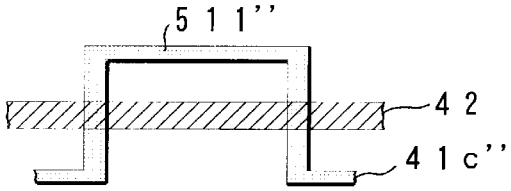

FIGS. 5A–5C show a third example of the main electrode shape.

In the plasma display panel 1*c* too, each of the main electrodes Xc, Yc includes a belt-like transparent conductive film 41*c* extending in the row direction with meandering in the column direction and the above-mentioned metal film 42. The transparent conductive film 41*c* is like ribbon that is thinner than the transparent conductive film 41*b* of the second example. The transparent conductive film 41*c* is patterned in the shape including plural gap forming portions 411*c*, 412*c* that has a half circle shape (C-shape) protruding from the metal film 42 toward the enlarging portion 31A in each column. The gap forming portion 411*c* protruding upward in the figure includes a first linear pattern 511 extending in the row direction apart from the metal film 42 and the two second linear patterns 512, 513 connecting each end of the first linear pattern 511 to the metal film 42. In the same way, the gap forming portion 412*c* protruding downward in the figure also includes a first linear pattern 521 and two second linear patterns 522, 523. The length of the first linear patterns 511, 521 is selected so that the both ends are at a distance from the partition 29 by a constant length d. The arrangement distance Dc of the gap forming portions 411*c*, 421*c* is substantially larger than the partition distance of the narrowing portion 31B. By placing the first linear patterns 511, 521 at a distance from the partition 29, the ion impact to the fluorescent material can be reduced.

As shown in FIG. 5B or 5C, width of the first linear pattern 511' of the transparent conductive film 41*c*' or the first linear pattern 511" of the transparent conductive film 41*c*" is set properly so that the electrode area is optimized. By adopting the structure of the third example, the discharge current was reduced by approximately 70%, and the light emission efficiency was improved by approximately 20%.

Figure 6:
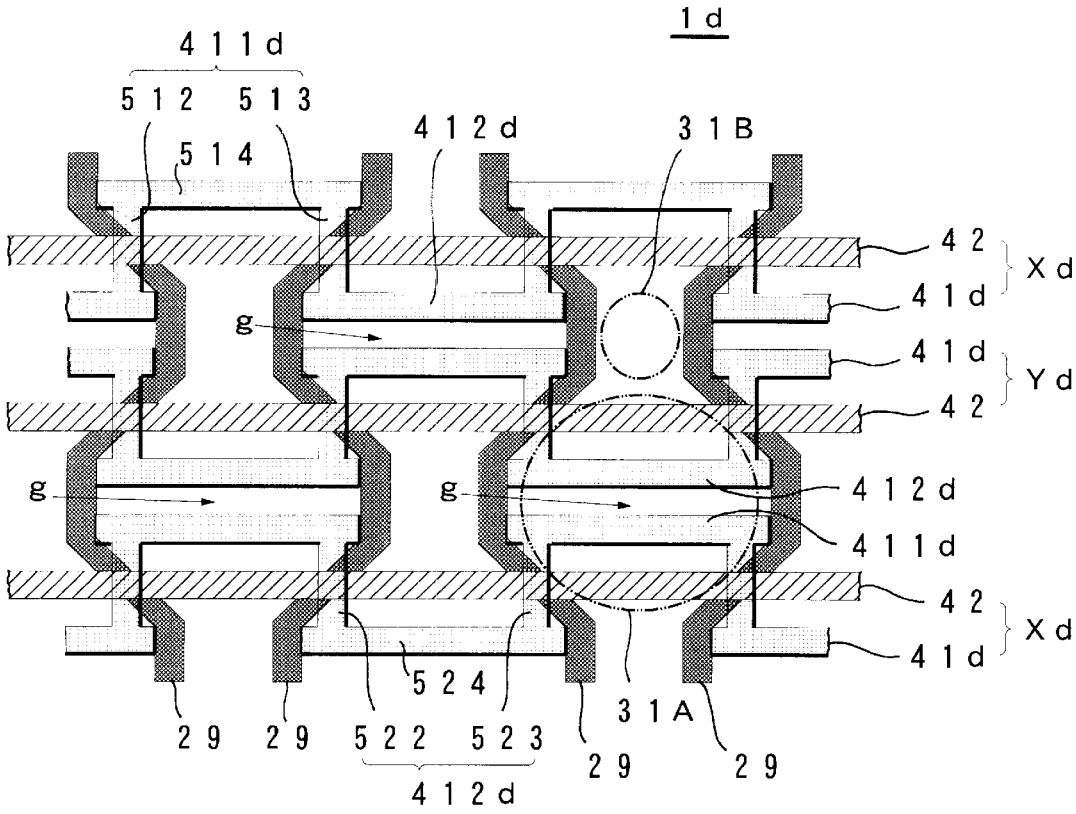
FIG. 6 shows a fourth example of the shape of the main electrode.

FIG. 6 shows a fourth example of the shape of the main electrode.

Basically, the electrode shape of the plasma display panel 1*d* in the fourth example is the same as that in the third example. A feature of this example is characterized in that both ends of the first linear patterns 514, 524 extending in the row direction protrude longer than the second linear patterns 512, 513, 523, 524 in the half circle portion constituting the gap forming portions 411*d*, 412*d* in the transparent conductive film 41*d*. The protruding portion makes the width of the surface discharge gap (an opposing distance of the electrodes) extend to increase the probability of discharge. As a result, the drive voltage can be reduced. A protrusion in the column direction can bring out the same effect.

Figure 7:
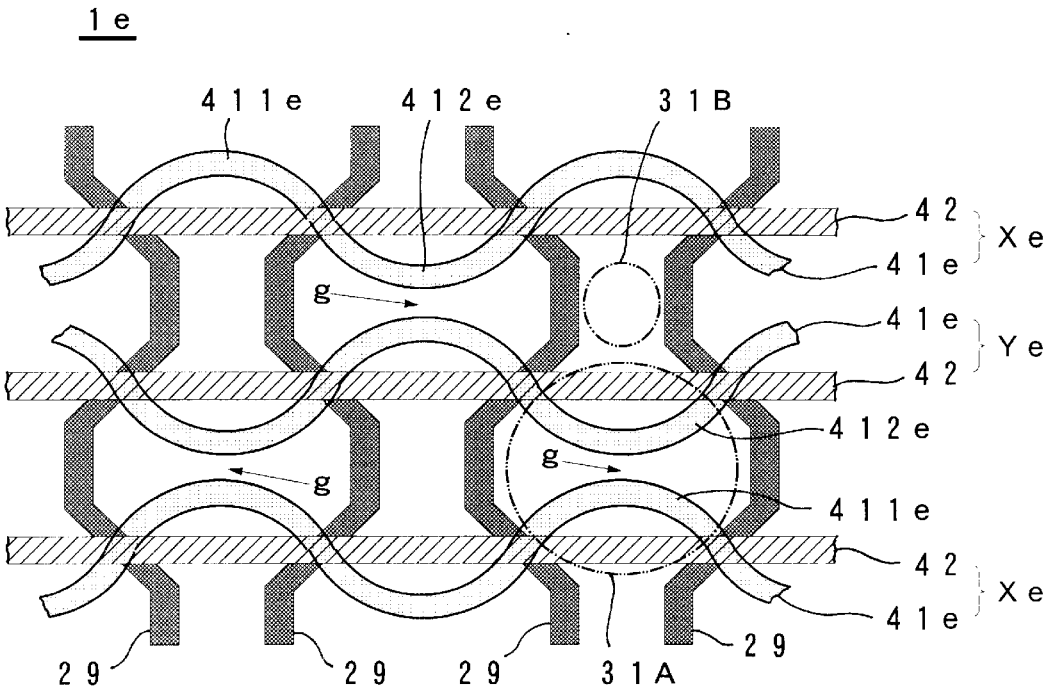
FIG. 7 shows a fifth example of the shape of the main electrode.

FIG. 7 shows a fifth example of the main electrode shape.

In the plasma display panel 1*e* too, each of the main electrodes Xe, Ye includes a transparent conductive film 41*e* extending in the row direction while meandering in the column direction and the above-mentioned metal film 42. The transparent conductive film 41*e* is patterned in a waving belt-like shape that has arc gap forming portions 411*e*, 412*e* protruding from the metal film 42 to the enlarging portion 31A for each column. In each enlarging portion 31A, the gap forming portions 411*c*, 412*e* of the main electrode X and the gap forming portions 411*e*, 412*e* of the neighboring main electrode Ye face each other so as to form a drum-like surface discharge gap g. Namely, the opposing sides of the gap forming portions 411*e*, 412*e* are not parallel. The width of the belt-like transparent conductive film 41*e* can alter regularly.

According to the fifth example, without increasing the surface discharge gap length (the minimum distance between the electrodes), the average of the distance between the electrodes can be reduced substantially so that the capacitance can be reduced. In the same way as the third example the interference of discharge can be prevented and the discharge current can be reduced. In addition, the reactive current was reduced by approximately 20% compared with the third example, so that the light emission efficiency was improved by approximately 30%.

Figure 8:
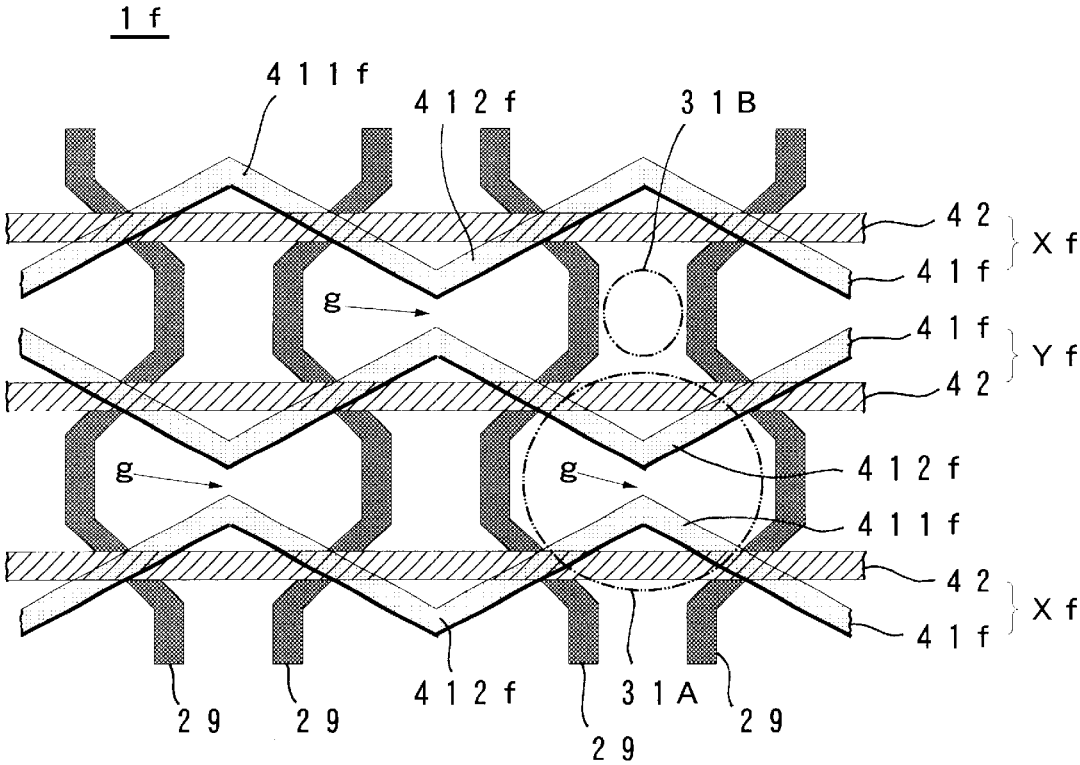
FIG. 8 shows a sixth example of the shape of the main electrode.

FIG. 8 shows a sixth example of the main electrode shape.

In the plasma display panel 1*f* too, each of the main electrodes Xf, Yf includes a meandering transparent conductive film 41*f* and the above-mentioned linear belt-like metal film 42. The transparent conductive film 41*f* bends like a triangular wave and is patterned in the shape having a gap forming portions 411*f*, 412*f* protruding from the metal film 42 toward the enlarging portion 31A like a mountain in each column. In each enlarging portion 31A, the gap forming portions 411*f*, 412*f* of the main electrode Xf and the neighboring gap forming portions 411*f*, 412*f* of the main electrode Yf form a surface discharge gap g. In this sixth example too, the opposing sides of the gap forming portions 411*f*, 412*f* are not parallel to obtain the same effect as the fifth example.

Figure 9:
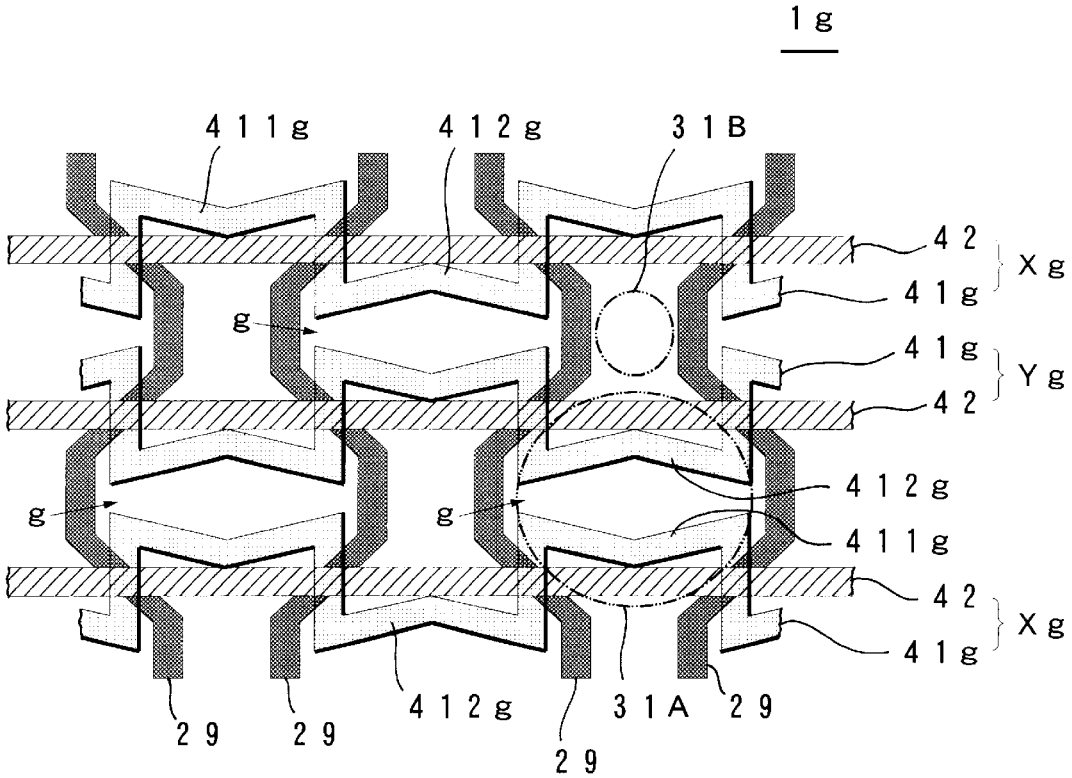
FIG. 9 shows a seventh example of the shape of the main electrode.

FIG. 9 shows a seventh example of the main electrode shape.

In the plasma display panel 1*g*, each of the main electrodes Xg, Yg includes a meandering belt-like transparent conductive film 41*g* and the above-mentioned linear belt-like metal film 42. The transparent conductive film 41*g* bends regularly and is patterned in the shape having gap forming portions 411*g*, 412*g* protruding from the metal film 42 toward the enlarging portion 31A in each column. In each enlarging portion 31A, the gap forming portions 411*g*, 412*g* of the main electrode Xg and the neighboring gap forming portions 411*g*, 412*g* of the main electrode Yg form the surface discharge gap g. The discharge is concentrated in right and left side portions of the enlarging portion 31A. In this seventh example too, the opposing sides of the gap forming portions 411*g*, 412*g* are not parallel to each other to obtain the same effect as the fifth or sixth example.

Figure 10:
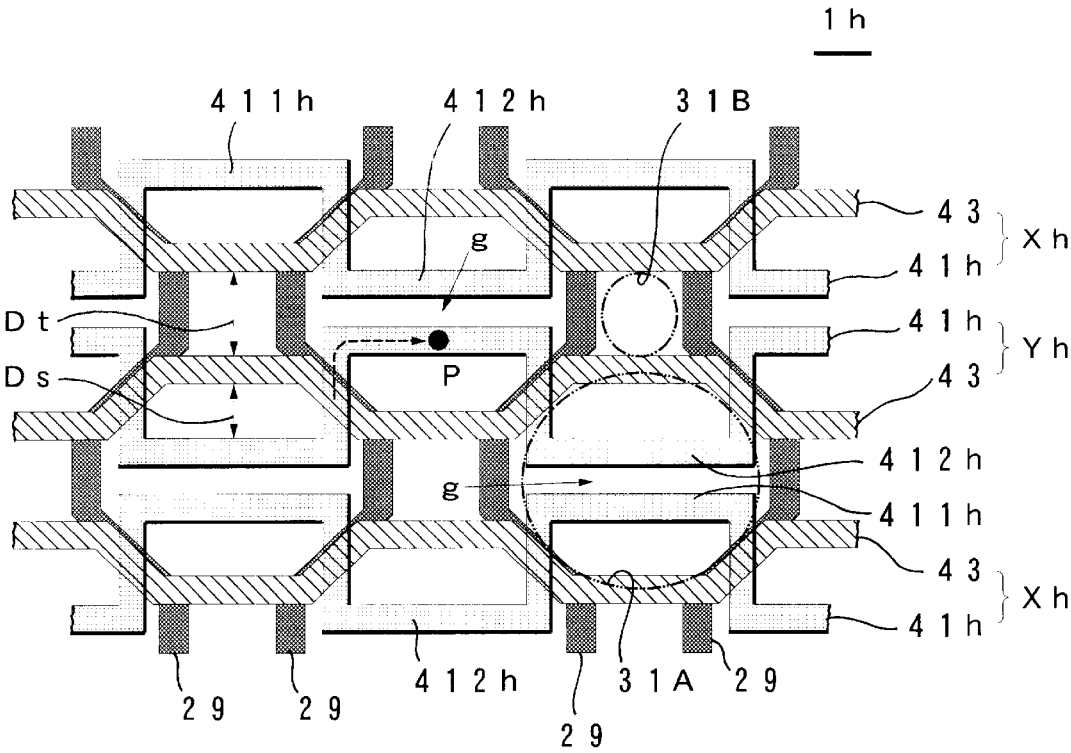
FIG. 10 shows an eighth example of the shape of the main electrode.

FIG. 10 shows an eighth example of the main electrode shape.

In the plasma display panel 1*h*, each of the main electrodes Xh, Yh includes a meandering belt-like transparent conductive film 41*h* similar to the third example shown in FIGS. 5A–5C and the belt-like metal film 43 extending in the row direction along the partition 29 while meandering so as to avoid the enlarging portion 31A. In each enlarging portion 31A, the gap forming portions 411*h*, 412*h* of the main electrode Xh and the neighboring gap forming portions 411*h*, 412*h* of the main electrode Yh form the surface discharge gap g.

In this eighth example, the minimum distance Dt between the neighboring metal films 43 becomes smaller than that of the third example shown in FIGS. 5A–5C, but the distance Ds between the transparent conductive film 41*h* and the metal film 43 at the center portion of the enlarging portion 31A in the row direction becomes large. Since the intensity of the electric field is small in the gap between the transparent conductive film 41*h* and the metal film 43, the interference of the discharge between the rows can be suppressed to the same extent as the third example shown in FIGS. 5A–5C. As an additional effect, light shield by the metal film 43 is reduced so that the light emission efficiency can be improved. By adopting the eighth example, the interference of the discharge was prevented in the same way as the third example and the light emission efficiency was improved by approximately 10% compared with the third example, and by approximately 40% compared with the conventional structure.

Figure 11:
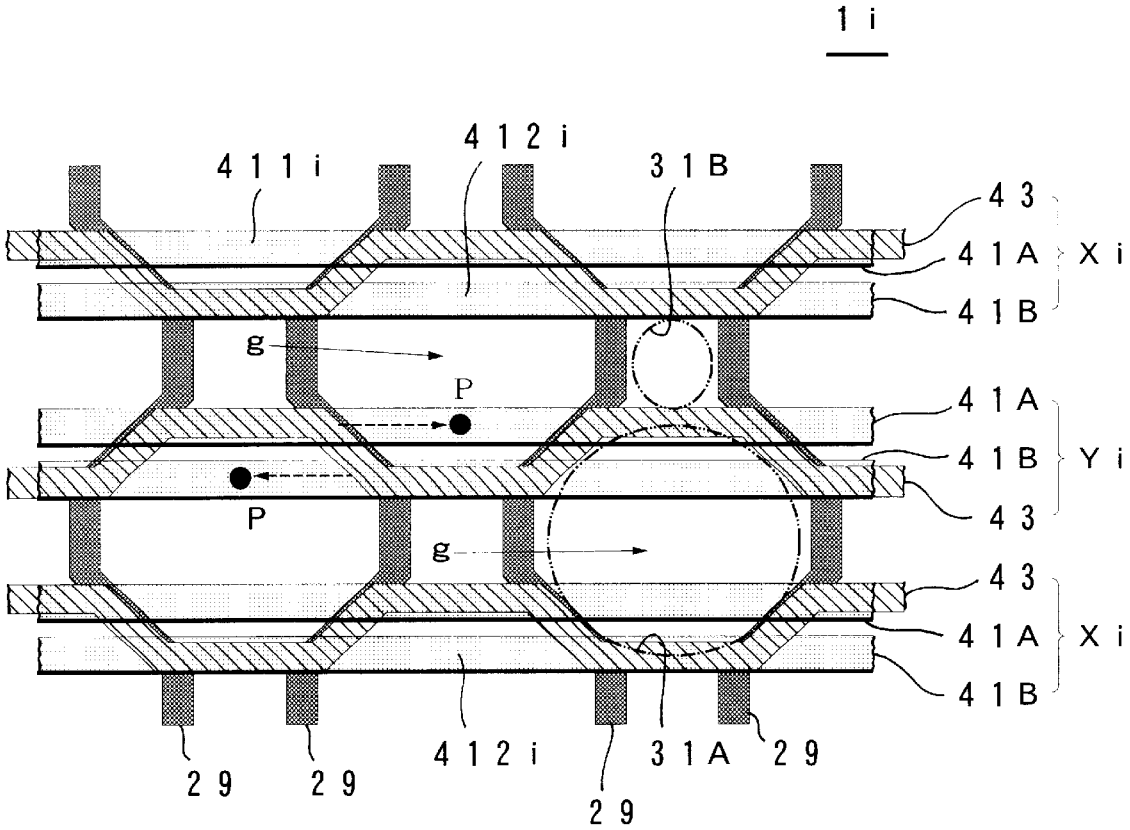
FIG. 11 shows a ninth example of the shape of the main electrode.

FIG. 11 shows a ninth example of the main electrode shape.

In the plasma display panel 1*i*, each of the main electrodes Xi, Yi includes two linear belt-like transparent conductive films 41A, 41B extending in parallel in the row direction over the full length of the screen and the metal film 43 extending in the column direction while meandering in the same way as in FIG. 10. In each enlarging portion 31A, the transparent conductive films 41A, 41B of the main electrode Xi and the transparent conductive films 41B, 41A of the neighboring main electrode Yi form the surface discharge gap g. The portions of the transparent conductive films 41A, 41B that do not overlap the metal film 43 are the gap forming portions 411*i*, 412*i*.

In this ninth example, the minimum conductive path (shown in a broken line with an arrow in the figure) from the metal film 43 to the center position P of the gap forming portions 411*i*, 412*i* is shorter than that of the eighth example shown in FIG. 10, so the voltage drop due to the resistance of the transparent conductive film is relatively small.

Figure 12:
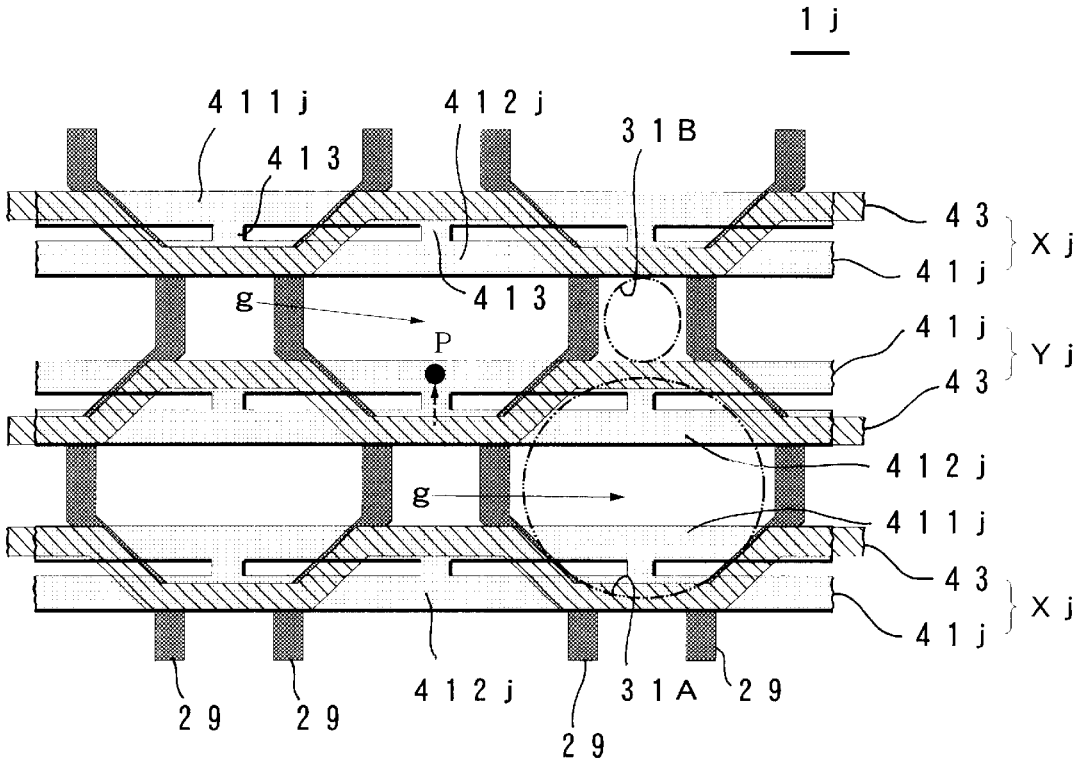
FIG. 12 shows a tenth example of the shape of the main electrode.

FIG. 12 shows a tenth example of the main electrode shape.

In the plasma display panel 13, each of the main electrodes Xj, Yj includes a ladder-like transparent conductive film 413 extending in the row direction over the full length of the screen and the belt-like metal film 43 meandering as explained above. The portions of the transparent conductive film 41*j* that do not overlap the metal film 43 are the gap forming portions 411*j*, 412*j*. In each enlarging portion 31A, the gap forming portions 411*j*, 412*j* of the main electrode Xj and the gap forming portions 411*j*, 412*j* of the neighboring main electrode Yj form the surface discharge gap g. The shape of the transparent conductive film 41*j* is one that the transparent conductive films 41A, 41B of the ninth example shown in FIG. 11 are connected at the center of each column. By providing the connection pattern 413, the minimum conductive path (shown in a broken line with an arrow in the figure) from the metal film 43 to the center position P of the gap forming portions 411*j*, 412*j* becomes shorter than the ninth example shown in FIG. 11. However, since the effect of preventing the interference of the discharge is reduced, it is necessary that at least the width of the connection pattern 413 is set smaller than the partition distance of the narrowing portion 31B. By adopting the eighth example, the light emission efficiency was improved by approximately 30%.

In the above-explained embodiments, the shape of the partition can be changed variously. For example, a partition can include a base portion extending in the column direction in a plan view and a portion protruding from the base portion. In this case, the column space 31 can be formed in which the enlarging portion 31A and the narrowing portion 31B are arranged alternately.

In the above-explained embodiments, the main electrodes X, Xb-Xj, Y and Yb-Yj are disposed at the front side of the discharge space 30, i.e., a so-called reflection type is illustrated. However, the electrode structure shown in FIGS. 3–9 can be applied to a transparent type plasma display panel in which the main electrodes X, Xb-Xg, Y and Yb-Yg are disposed at the rear side. In the transparent type the entire of the main electrodes X, Xb-Xg, Y and Yb-Yg (the bus portion and the gap forming portion) can be formed by patterning a metal film. If the main electrode is made of only a metal film, the bus portion and the gap forming portion of the present invention are formed integrally. Therefore, the bus portion of the second structure of the present invention and the conductive film protruding to both sides of the bus portion have a common part. In addition, in the first through the seventh examples shown in FIGS. 3–9, the linear belt-like metal film can be replaced with the meandering belt-like metal film of the eighth example shown in FIG. 10.

As explained above, the interference of discharge between rows can be prevented securely without reducing an operation margin according to the present invention. In addition, a capacitance between main electrodes can be reduced.

Furthermore, the light shield due to the main electrode is eliminated so that the light emission efficiency can be improved.

What is claimed is:

1. A plasma display panel, comprising:

a plurality of partitions being apart from each other and defining a discharge space of each column in a screen;

a column space defined by the partitions, the column space being narrowed periodically along the column direction;

a surface discharge gap formed at each enlarging portion of the column space; and a pair of main electrodes for surface discharge, each of the main electrodes including a belt-like bus portion extending in the row direction of the screen and plural gap forming portions protruding from the bus portion in the column direction at each intersection with the partition.

2. The plasma display panel according to claim 1, wherein the arrangement distance of the plural gap forming portions in the row direction is substantially equal to the partition distance of the narrowing portion of the column space or is larger than the same.

3. The plasma display panel according to claim 1, wherein the bus portion is made of a metal film, and each of the plural gap forming portions is made of a transparent conductive film that is patterned so as to protrude from the bus portion to both sides in the column direction.

4. A plasma display panel, comprising:

a plurality of partitions being apart from each other and defining a discharge space of each column in a screen;

a column space defined by the partitions, the column space being narrowed periodically along the column direction;

a surface discharge gap formed at each enlarging portion of the column space; and a pair of main electrodes for surface discharge, each of the main electrodes including a belt-like bus portion extending in the row direction of the screen and plural gap forming portions protruding from the bus portion toward the enlarging portion in the column direction in each column space.

5. The plasma display panel according to claim 4, wherein the arrangement distance of the plural gap forming portions in the row direction is substantially equal to the partition distance of the narrowing portion of the column space or is larger than the same.

6. The plasma display panel according to claim 4, wherein the bus portion is made of a metal film, and each of the plural gap forming portions is made of a transparent conductive film that is patterned in the belt-like shape extending in the row direction while meandering in the column direction.

7. The plasma display panel according to claim 4, wherein each of the plural gap forming portions includes a first linear pattern extending in the row direction at a distance from the bus portion and two second linear patterns that connect each end of the first linear pattern to the bus portion.

8. The plasma display panel according to claim 7, wherein both ends of the first linear pattern protrude from the second linear pattern connecting the first linear pattern in the row direction.

9. The plasma display panel according to claim 4, wherein each of the plural gap forming portions is patterned in such a shape that opposing sides of the plural gap forming portions and the other main electrode forming the surface discharge gap together are not parallel to each other.

10. The plasma display panel according to claim 9, wherein each of the plural gap forming portions has an arc shape whose ends are connected to the bus portion.

11. A plasma display panel, comprising:

a plurality of partitions being apart from each other and defining a discharge space of each column in a screen;

a column space defined by the partitions, the column space being narrowed periodically along the column direction;

a surface discharge gap formed at each enlarging portion of the column space;

a pair of main electrodes for surface discharge arranged at the front side of the discharge space, each of the main electrodes including a belt-like bus portion extending in the row direction while meandering in the column direction along the partition in a plan view and plural gap forming portions protruding from the bus portion toward the enlarging portion in the column direction in each column space;

the bus portion being made of a metal film; and each of the plural gap forming portions having a belt-like shape connected to the bus portion only at both ends, and being made of a transparent conductive film extending in the row direction while meandering in the column direction.

12. A plasma display panel, comprising:

a plurality of partitions being apart from each other and defining a discharge space of each column in a screen;

a column space defined by the partitions, the column space being narrowed periodically along the column direction;

a surface discharge gap formed at each enlarging portion of the column space; and a pair of main electrodes for surface discharge arranged at the front side of the discharge space, each of the main electrodes including a belt-like bus portion extending in the row direction while meandering in the column direction along the partition in a plan view and plural linear belt-like gap forming portions protruding in the row direction at each enlarging portion of the column space, each of the main electrodes being patterned in the shape having a gap between each of the plural gap forming portions and the bus portion;

the bus portion being made of a metal film, and the plural gap forming portions being made of a transparent conductive film.

13. The plasma display panel according to claim 12, wherein each of the plural main electrodes is made of the metal film and at least two linear belt-like transparent conductive films extending in the row direction over the full length of the screen while being at a distance from each other.

14. The plasma display panel according to claim 12, wherein the transparent conductive film is patterned in the shape having a connection pattern for connecting the center of each gap forming portion in the row direction to the bus portion.

* * * * *